United States Patent [19]

Lambach et al.

[11] 4,228,900

[45] Oct. 21, 1980

[54] PACKING OF THE FOLDING BAG TYPE, PRIMARILY FOR PIPE TOBACCO, AND A FOLDING BAG MEMBER FOR SUCH A PACKING

[75] Inventors: Heinrich W. Lambach; Leif Sörensen, both of Horsens, Denmark

[73] Assignee: Brdr. Schur International A/S J. W. Schursvej, Denmark

[21] Appl. No.: 943,125

[22] Filed: Sep. 18, 1978

[30] Foreign Application Priority Data

Sep. 16, 1977 [GB] United Kingdom ..... 38789/77

[51] Int. Cl.[3] ..... A24F 23/02

[52] U.S. Cl. ..... 206/260; 209/62; 150/43

[58] Field of Search ..... 206/260; 229/62; 150/12, 43

[56] References Cited

U.S. PATENT DOCUMENTS

| | | | |
|---|---|---|---|
| 3,380,576 | 4/1968 | Deimann | 206/260 |
| 3,460,742 | 8/1969 | Langdon | 229/62 |
| 3,471,005 | 10/1969 | Sexstone | 206/260 |
| 3,596,828 | 8/1971 | Foster | 229/62 |
| 3,761,013 | 9/1973 | Schuster | 229/62 |

FOREIGN PATENT DOCUMENTS

| | | | |
|---|---|---|---|
| 642351 | 8/1950 | United Kingdom | 206/260 |

*Primary Examiner*—Herbert F. Ross

*Attorney, Agent, or Firm*—Craig & Antonelli

[57] ABSTRACT

A plastic sheet packing or packing member of the flat folding bag type, primarily for pipe tobacco, the mouth opening of which is sealed in a welded manner enabling it to be opened without rupturing the sheet materials adjacent the mouth opening. The mouth is closed by a type of welding providing a good sealing effect though being releasable by mechanical pull to facilitate opening of the packing. The opposed surface portions of the mouth area may be welded direct to each other in this manner, or a separate, removable closing strip may be arranged along and across the mouth and secured by the releasable type of welding. This type of welding may require mutually different materials to be joined, and this is obtained either by the use of said separate strip or by using a sandwich sheet for the packing itself.

2 Claims, 4 Drawing Figures

Figure 1:
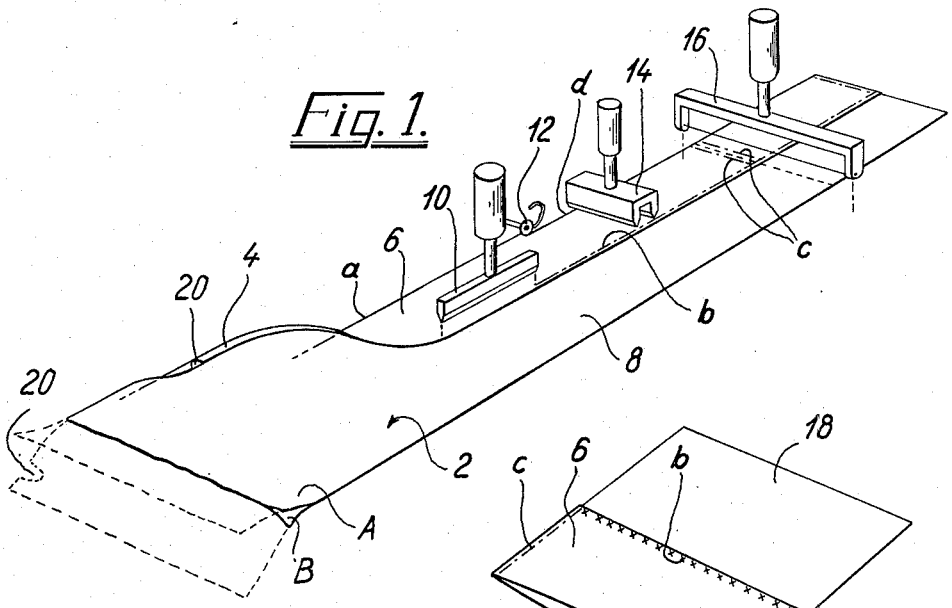

PACKING OF THE FOLDING BAG TYPE, PRIMARILY FOR PIPE TOBACCO, AND A FOLDING BAG MEMBER FOR SUCH A PACKING

This invention relates to a packing of the folding bag type, primarily for pipe tobacco, and of the kind formed by two opposed walls of plastic sheet material permanently joined along a bottom edge and two side edges, and releasably joined along an upper mouth edge. In fully conventional tobacco pouches the bag mouth is closed by the very folding of the bag, but this is no tight closure, and often the tobacco has dried or lost aroma on its way to the customer.

It has been endavoured to obtain a tight closure by way of a ziplock profilation of the opposed mouth edges or by means of a zone of adhesive located on the outside of the bag such that the mouth of the folded bag is tightly and releasably closed when the mouth area is pressed against the adhesive (see U.S. patent application No. 729,012). These known proposals, however, show certain drawbacks as far as both production and use are concerned. It has been desired that the closure should be re-closable, but in practice this has been difficult e.g. because of tobacco particles deposited in the closing area. On the other hand it has also been recognized that a sealed re-closing is not very important, if it is ensured that the bag is sealed in the filling plant and remains sealed until it is opened the first time.

The present invention is based on the idea that the closure may be simplified if in advance any intension of providing a re-closable closure is given up, though of course the condition still exists that the sealed closure should be breakable or releasable without the bag mouth portion as such being damaged. Thus, it is the purpose of the invention to provide a packing of the kind referred to, which is sealingly closed in a simple manner and openable in an easy and non-destructive manner.

According to the invention there is provided a folding bag packing of the type referred to, in which the releasable joint between the bag wall portions along the mouth edge is provided by one or more weldings of such a character that the closure is tight, but easily breakable without the joined sheet materials being ruptured.

Thus, in connection with the invention the closure is made so as to be definitely non-resealable in ordinary use of the packing, once the original seal has been broken, and the resulting advantage is that for providing the original sealing it is sufficient to manufacture the packing members in a simple manner and effect the sealing by simple means, while a further advantage is that the packing, when used, will show practically no rudiments of any original sealing arrangement.

It has been found that it is in fact possible to weld together two plastic sheet materials in the said sealed, but releasable manner, a preferred method being to make use of two selected mutually different sheet materials and to control the applied welding heat rather accurately. It may even be possible to carry out the welding between similar sheet materials, when at least one of them is provided with a surface coating preventing a real melting together of the welded surface portions.

As far as the provision of a welded seal between different materials is concerned, the mouth portion of a folding bag presents the difficulty that the surface portions facing each other in the mouth area will be of the same material. The invention provides for two different solutions of this problem, one being to use a sandwich sheet of two different sheet materials and folding inwardly an edge portion of the mouth edge of the front wall, whereby the surfaces to be welded together will be of mutually different materials, and the other solution being to provide along and across the mouth area a separate closing sheet strip of a different material welded in said releasable manner to the outside of the front wall portion and the inside of the folding flap portion, respectively, whereby the closing or sealing strip may simply be torn off for opening the bag mouth.

Figure 2:
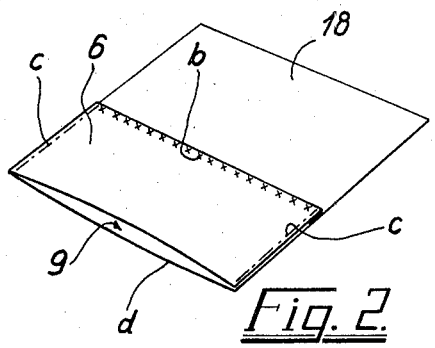
Figure 3:
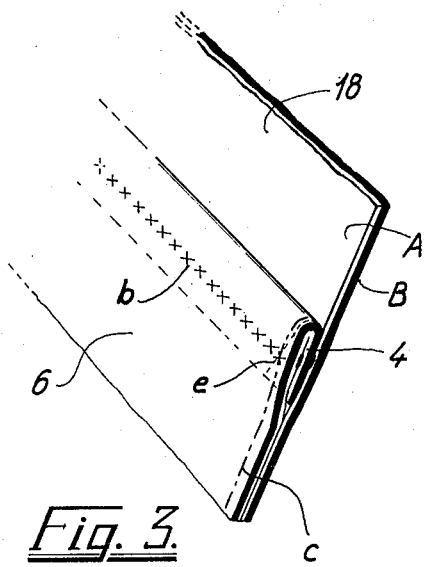
Figure 4:
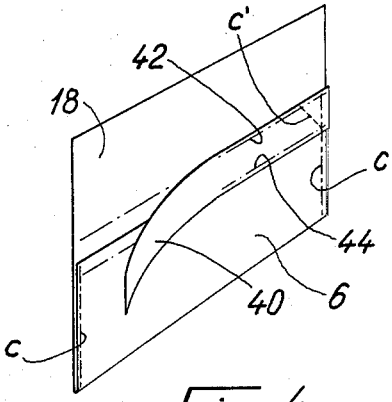

In the following the invention is described in more detail with reference to the accompanying drawing, in which:

FIG. 1 is a schematic perspective view illustrating a method of industrial production of pouch members according to the invention, FIG. 2 is a perspective view of a pouch member as produced, FIG. 3 is an enlarged view of a portion thereof, and FIG. 4 is a perspective view of a modified pouch member.

In FIG. 1 it is shown that a continuous sheet length 2 supplied from a supply reel (not shown) is advanced through a pouch making machine in which the sheet is first provided with an edge fold 4 and thereafter is folded along a line a whereby a sheet portion 6 including the folded edge portion 4 is laid onto a sheet portion 8 of larger width. A welding tool 10 operates to weld together the edge portion 4 and the sheet portion 8 along a line b. A cutter 12 serves to cut open the sheet fold along the line a, and a subsequent cross welding tool 14 serves to weld together the two sheet layers 6 and 8 along spaced transverse lines c. In the following operation a cross cutting tool 16 operates to consecutively cut off the front end of the sheet length between the respective pairs of transverse welding lines c, whereby separate pouch members are delivered from the pouch making machine.

One such pouch member is shown in FIG. 2. It comprises a front wall portion 6 and a rear wall portion 9, these portions being welded together along side edge welding lines c and along a welding line b adjacent the top edge of the front portion 6. The bottom of the pouch is open along line d (as cut by the cutter 12), and the rear wall portion 9 has an upper flap portion 18 extending upwardly beyond the top edge of the front portion 6. In a filling plant the pouch member may be filled through the open bottom portion which is therafter closed by welding, and the pouch may then be rolled or folded together as desired.

As more clearly shown in FIG. 3 the top edge portion of the front wall 6 comprises the folded edge portion 4 (FIG. 1), the outer surface of which is welded to the rear wall portion 9 along the line b.

As shown in FIGS. 1 and 3 the sheet length 2 is a sandwich sheet having at one side a surface layer or film A generally forming the inside layer of the pouch and having at the opposite side a surface layer or film B generally forming the outside layer of the folded pouch. One or more further sheet layers may be interposed between said outer surface layers A and B.

When the sheet length 2 is folded about the line a (FIG. 1) the layer A of the sheet portion 6 will generally face the corresponding layer A of the sheet portion 9, and the welding tool 14 will cause these layers to be welded firmly together along the cross lines c.

Along the folded top edge portion 4 of the front sheet 6, however, the surface layer A of the rear sheet portion 9 will be faced by the surface layer B of the folded top edge portion, and when A and B are chosen from materials which are not too easily welded together the welding along the line b may well be a tight and sealing welding, but also a welding which is openable by pulling away the folded edge portion from the surface of the rear portion 9, without the respective surfaces being destroyed hereby. The user of the pouch cannot reseal the mouth portion, but he will know that the pouch has remained sealed from it was filled until he opens it the first time, and in most cases this will be fully sufficient.

The relatively weak welding of the materials A and B along the line b applies equally to the uppermost ends of the side welding lines c across the folded edge portion 4. If it is desired to make the ends of the portion 4 welded permanently to the rear wall 9 it will be possible to cut away, prior to the lamination of the sheets A and B (FIG. 1), those portions 20 of the sheet B which would otherwise—by the pouch member production—be located in the c-line-area of the folded edge portion 4. When these portions 20 are cut away it will be the A-sheet of the fold edge 4 which is welded against the A-sheet of the rear wall 9, whereby a firm welding is obtained along the top ends of the lines c.

If desired the welding along the line b may even be done with the flap portion 18 folded about the top edge portion 4, as hereby a similar "bad" and thus openable welding is obtained between the inside (A) of the flap and the outside (B) of the folded portion 4.

In FIG. 4 is shown a modified embodiment of the invention. For the temporary sealing of the bag mouth is here used a separate closing sheet strip 40 which is placed along and across the mouth edge and welded along an upper line 42 to the inner or front side of the folding flap 18 and along a lower line 44 to the front side of the front wall 6 of the bag portion. The side weld lines c are upwardly extended up to or past the line 42, such that the strip 40 due to said welds keeps the pouch mouth completely closed, though the welds are of the said releasable type, whereby they allow the strip to be torn away for opening the bag portion. In this embodiment the front wall 6 need not have any folded edge portion 4, and the bag or pouch member itself may consist of a single layer sheet material of a first type, while the closing strip 40 consist of such a different sheet type which is releasably weldable to the first type. It will be perfectly possible to use a sandwich sheet for the pouch member, but it should even be preferred that the two outer sheets be of the same type of material. Even the strip 40 could be of the same material, too, if it is so prepared or coated that it is weldable to the pouch sheet in the desired releasable manner.

The pouch member shown in FIG. 4 may be manufactured almost as illustrated in FIG. 1; the edge fold 4 may be avoided, and a continuous strip 40 should be laid against the pouch mouth area in front of the tool 10, which should be adapted so as to provide both of the weld lines 42 and 44. In order to facilitate the removal of the strip 40 from the pouch the tool 14 may be shaped so as to make the upper end of the weld line c, at least at one side of each pouch member, extend upwardly and inwardly across the strip 40, as shown by a dotted line c′ in FIG. 4; if hereby the weld line 42 extends outwardly only to the upper end of line c′ there will be left an easily seizable outer strip corner portion outside the line c′.

If the pouch member shown in FIG. 4 is manufactured as described above the risk may occur that the interior sides of the bag portion are welded firmly to each other along the line 44 by the heat used for welding the strip 40 to the pouch member along this line. Such a calamity may be avoided by placing a stationary separator plate (not shown) between the sheets 6 and 8 underneath the tool 10. Alternatively the strip 40 may be fed to the edge of the sheet length 2 before the folding thereof and be welded to the sheet edge along the line 44, whereafter the sheet is folded and the strip portion protruding beyond the edge of the sheet is welded to the sheet layer 8 along the line 42 and the lines c(c′).

By the production of bottomwise open pouch members it will of course be possible to make use of two separate sheet lengths 6 and 8, but it is no condition that the bottom be open, because it may be chosen to leave a side edge or even the bag mouth open for filling purposes and subsequent sealing; thus, the weld line 42 (FIG. 4) could be provided in the filling plant upon the bag being filled through its natural mouth. However, until further it seems as though the welding operations for providing for releasable welds require such accurate control that it will be preferable to carry out all welds of this type, i.e. the mouth sealing, in the pouch factory and leave to the filling plant to close a filling opening outside the immediate mouth area, by welding or otherwise.

In the embodiment of FIG. 4 the strip 40 may well be welded firmly along one of the lines 42 or 44, preferably along the latter, if the weld along the other of these lines is easily breakable, e.g. if the pouch is made of a sandwich sheet, the outermost layer of which is firmly weldable to the strip sheet, while the innermost layer or film is releasably weldable thereto, or if the strip is coated on one half thereof so as to be releasably weldable along one line and firmly weldable along the other line.

It will be appreciated that while in FIG. 4 the folding flap 18 is used for holding the upper edge of the strip 40, the sealing according to FIG. 2 is not conditioned by the existence of the flap 18. Besides, flap 18 could terminate just above line 42.

The releasable welding as here in question was originally developed for sealing plastic containers by means of a retractable sheet lid member welded to the top edge of the container (by a so-called "peel seal" weld), but in connection with the invention it has been found that it is perfectly possible to use a similar type of welding for closing the mouth of a sheet bag portion, the other edges of which are closed otherwise, in order to obtain the advantages described hereinbefore. As preferred materials should be mentioned polyethylene for the sheet A and for the pouch of FIG. 4 and a ionomer or polypropylene for the sheet B and for the strip 40.

The invention also comprises the pouch or packing members discussed above, the mouth areas of which are preclosed in a releasable manner, while they are adapted to be filled through another, separately and permanently closable opening.

What we claim is:

1. A packing of the folding bag type, particularly for pipe tobacco, comprising a bag portion formed by two opposed front and rear wall portions of plastic sheet material which are permanently joined along a bottom edge and two side edges, while along an upper mouth edge they are joined in a sealed, yet releasable manner, the rear wall portion being extended upwardly forming a folding flap portion which, when the packing is folded together, is laid against the outside of said bag portion, characterized in that the mouth edge is closed by means of a sheet strip member laid over and along the mouth edge and welded to the outside of the front wall portion and the inside of the folding flap portion, respectively, at least one of these welds being of a breakable or releasable type, in which the sheet strip member consists of a sheet material different from the bag sheet material and is additionally welded releasably to the bag portion adjacent the side edges of the bag portion by end weld lines extending up to the welding line area between the strip member and the folding flap portion, in which said end weld lines at least at one end of the strip member extend upwardly and inwardly to form an easily seizable end portion of the strip member.

2. A packing of the folding bag type, particularly for pipe tobacco, comprising a bag portion formed by two opposed front and rear wall portions of plastic sheet material which are permanently joined along a bottom edge and two side edges, while along an upper mouth edge they are joined in a sealed, yet releasable manner, the rear wall portion being extended upwardly forming a folding flap portion which, when the packing is folded together, is laid against the outside of said bag portion, in which the releasable joining of portions of the sheet material is a welded area or areas of mutually different plastic materials particularly suited to be welded together in an easily breakable manner, said plastic sheet material being a sandwich material having an innermost sheet and an outermost sheet, characterized in that the innermost sheet of the bag portion is of one material type and the outermost sheet is of another type, the upper edge area of the front wall portion being inwardly folded and welded direct to an adjacent inner surface of the rear wall portion, and in which said outermost sheet is locally cut away at the ends of the folded edge portion in a manner resulting in the innermost sheet of the front wall portion being permanently joined to said innermost sheet of the rear wall at the weldment of the two side edges of the folded edge portion.

* * * * *